US009249798B2

(12) United States Patent
Ganguly et al.

(10) Patent No.: US 9,249,798 B2
(45) Date of Patent: Feb. 2, 2016

(54) AUTOFRETTAGE PROCESS FOR A PUMP FLUID END

(75) Inventors: Partha Ganguly, Belmont, MA (US); Jahir Pabon, Wellesly, MA (US); Joe Hubenschmidt, Sugar Land, TX (US); Nathan St. Michel, Houston, TX (US); Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1077 days.

(21) Appl. No.: 11/558,261

(22) Filed: Nov. 9, 2006

(65) Prior Publication Data

US 2008/0000065 A1 Jan. 3, 2008

Related U.S. Application Data

(60) Provisional application No. 60/805,621, filed on Jun. 23, 2006.

(51) Int. Cl.
*B23P 15/00* (2006.01)
*F04B 53/16* (2006.01)

(52) U.S. Cl.
CPC ..... *F04B 53/162* (2013.01); *Y10T 29/49805* (2015.01)

(58) Field of Classification Search
CPC ..... C21D 7/02; C21D 7/08; B23P 11/02; Y10T 29/49863; Y10T 29/49236; F04B 47/00; F04B 53/16; F04B 1/0421; B29C 70/446; B30B 15/042; Y10S 425/026
USPC ..... 29/888.02, 421.1, 446, 447, 890.14; 72/56, 61
See application file for complete search history.

(56) References Cited

U.S. PATENT DOCUMENTS

| | | | | |
|---|---|---|---|---|
| 4,229,011 | A | 10/1980 | Wikelski | |
| 4,354,371 | A | 10/1982 | Johnson | |
| 4,417,459 | A | 11/1983 | Tomita | |
| 4,571,969 | A | 2/1986 | Tomita | |
| 5,605,449 | A | 2/1997 | Reed | |
| 6,418,770 | B1 | 7/2002 | Binno | |
| 7,484,452 | B2 * | 2/2009 | Baxter et al. | 92/169.1 |
| 2006/0002806 | A1 | 1/2006 | Baxter | |

FOREIGN PATENT DOCUMENTS

| | | | | |
|---|---|---|---|---|
| CN | 1151446 | A | 6/1997 | |
| CN | 1151446 | A | 6/1997 | |
| GB | 627162 | A | 7/1949 | |
| GB | 2044347 | A | 10/1980 | |
| JP | 4232244 | A | 8/1992 | |
| JP | 2002-168497 | * | 1/2004 | B41J 5/06 |
| JP | 20049117 | A | 1/2004 | |
| JP | 2005095923 | A | 4/2005 | |
| RU | 2203435 | C2 | 4/2003 | |

* cited by examiner

*Primary Examiner* — Thiem Phan
(74) *Attorney, Agent, or Firm* — Michael L. Flynn; Rachel E. Greene; Tim Currington

(57) ABSTRACT

A multi-step autofrettage process for pre-treating a multi-cylinder reciprocating pump fluid end that has a central cylinder and at least two side cylinders is provided that includes autofrettaging the central cylinder; and autofrettaging the at least two side cylinders, wherein the autofrettaging of the central cylinder is performed independently of the autofettaging of the at least two side cylinders.

15 Claims, 2 Drawing Sheets

AUTOFRETTAGE PROCESS FOR A PUMP FLUID END

CROSS-REFERENCE TO RELATED APPLICATION

This application claims priority under 35 U.S.C. §119(e) to U.S. Provisional Application Ser. No. 60/805,621, filed on Jun. 23, 2006, which is incorporated herein by reference.

FIELD OF THE INVENTION

The present invention relates generally to an autofrettage process for mechanically pre-treating the fluid end of a multi-cylinder reciprocating pump in order to induce residual compressive stresses in the cylinders of the fluid end.

BACKGROUND

Hydraulic fracturing of downhole formations is a critical activity for well stimulation. Typically this is done by pumping fluids downhole at relatively high pressures so as to fracture the earth and rocks adjacent to the wellbore. Oil can then migrate to the wellbore through these fractures to significantly enhance well productivity. Reciprocating pumps, and more specifically triplex pumps, are generally used to pump the high pressure fracturing fluids downhole. However, repeatedly exposing the fluid end of the pump to high pressures causes the cylinders in the fluid end to be susceptible to fatigue failure. As such, a need exists to increase fatigue resistance in the fluid end cylinders of a multi-cylinder reciprocating pump.

SUMMARY

An autofrettage process may be used to create compressive residual stresses in the inside walls of the fluid end of a multi-cylinder reciprocating pump, such that the tensile stress that the fluid end experiences during the pumping cycle is minimal. During autofrettage, the cylindrical bores of the fluid end are exposed to high hydrostatic pressures, which leads to plastic yielding in the inside regions of the fluid end, while the deformation in the outside region is elastic. When the pressure is removed, the outside region of the fluid end returns elastically, while the inside regions that were plastically deformed are now in compressive stress. This compressive stress enhances the fatigue resistance of the fluid end.

In one embodiment, the present invention includes a multi-step autofrettage process for pre-treating a multi-cylinder reciprocating pump fluid end that has a central cylinder and at least two side cylinders, wherein the process includes autofrettaging the central cylinder; and autofrettaging the at least two side cylinders. In this process, the autofrettaging of the central cylinder is performed independently of the autofettaging of the at least two side cylinders.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

Figure 1:
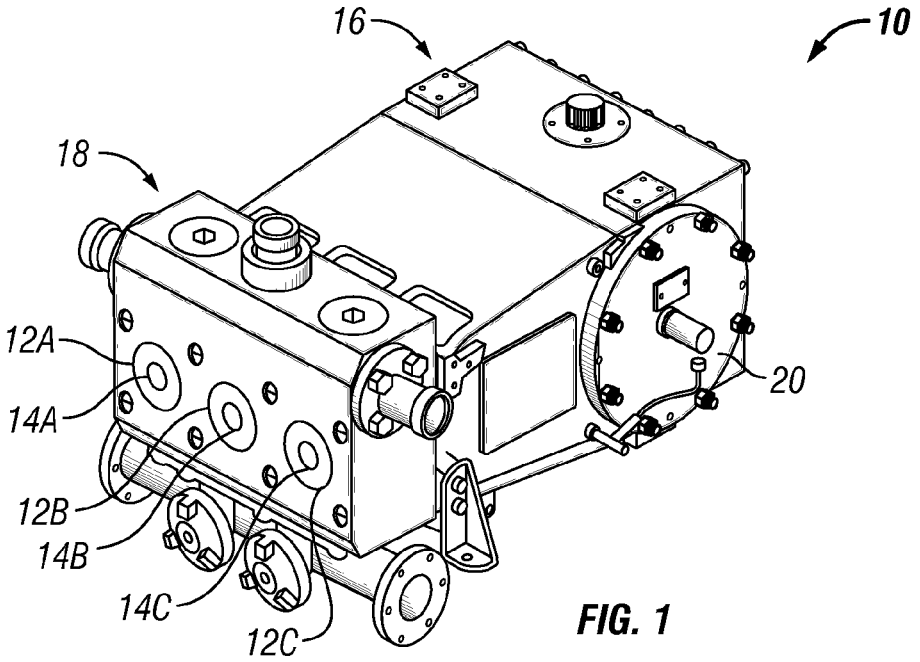
FIG. 1 is perspective view of a multi-cylinder reciprocating pump for use in an autofrettage process according to the present invention.

As discussed above, in oil and gas wells multi-cylinder reciprocating pumps are typically used to pump high pressure fracturing fluid downhole to stimulate well productivity. FIG. 1 shows an exemplary embodiment of such a pump 10. In the depicted embodiment, the pump 10 is a triplex pump having three cylinders 12A-12C, each with a corresponding plunger 14A-14C movably disposed with respect thereto. For the purpose of this document, the central of these three cylinders is referred to as the central cylinder 12B, and the remaining two cylinders are referred to as side cylinders 12A,12C. However, as discussed further below, the pump 10 may be a pump with any appropriate number of cylinders, such as five cylinder pump (a quintuplex pump) or seven cylinder pump (a heptaplex pump.)

In the depicted embodiment, the pump 10 contains two sections, a power end 16 and a fluid end 18. The power end 16 contains a crankshaft 20 powered by a motor assembly (not shown) to drive the pump plungers 14A-14C; and the fluid end 18 contains the cylinders 12A-12C into which the plungers 14A-14C reciprocate to draw in a fluid at low pressure and to discharge the fluid at a high pressure, as described further below.

Figure 2:
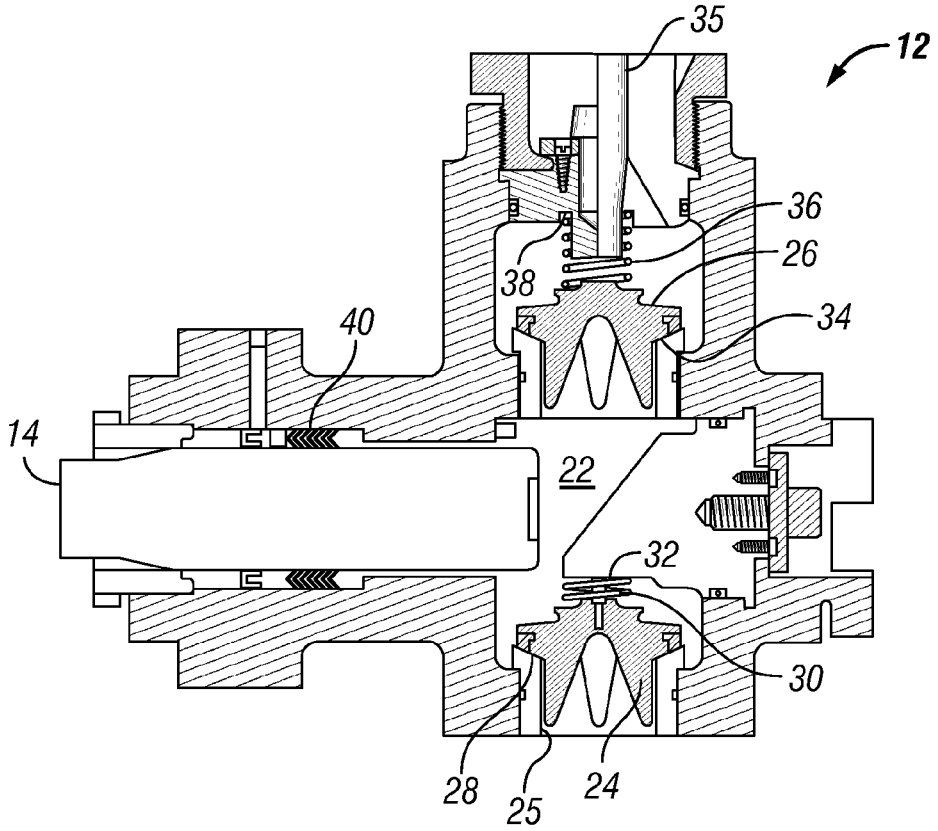
FIG. 2 is a cross-sectional view of one of the fluid end cylinders of the multi-cylinder reciprocating pump of FIG. 1.

For simplicity, FIG. 2 shows a cross section of only one cylinder 12 of the fluid end of a reciprocating pump. However, the illustrated cylinder 12 is representative of any one of the cylinders in a multi-cylinder reciprocating pump, such as a triplex pump, a quintuplex pump or a heptaplex pump, among other appropriate pumps. As such, any discussion below referring to the fluid end cylinder 12 applies equally to all three cylinders 12A-12C of the triplex pump 10 of FIG. 1, or any of the cylinders in a quintuplex pump or a heptaplex pump; and any discussion below referring to the plunger 14 applies equally well to all three plungers 14A-14C of the triplex pump 10 of FIG. 1, or any of the plungers in a quintuplex pump or a heptaplex pump.

As shown in FIG. 1, and discussed further below, each of the fluid end cylinders 12A-12C in the depicted triplex pump 10 includes a plunger 14A-14C movably disposed with respect thereto. Typically, when used for well fracturing purposes, the size of each plunger 14A-14C is approximately 4.5 inches to approximately 6.5 inches in diameter, with each plunger 14 generating pressures of up to approximately 12,000 psi (12 Ksi.)

As shown in FIG. 2, each cylinder 12 includes a fluid chamber 22. Each plunger 14 is slidably mounted within its corresponding cylinder 12 for reciprocating motion within the fluid chamber 22. The reciprocating motion of the plunger 14 acts to change the volume of fluid in the fluid chamber 22. The cylinder 12 further includes check valves, such as a suction valve 24 and a discharge valve 26, that control the flow of fluid into and out of the fluid chamber 22 as the plunger 14 reciprocates.

As mentioned above, the reciprocating motion of the plunger 14 may be generated by a motor driven rotating crankshaft 20. The suction valve 24 and the discharge valve 26 are actuated by fluid and spring forces. The suction valve 24, for example, is biased toward a suction valve seat 28, i.e. toward a closed position, by a spring 30 positioned between the suction valve 24 and a spring stop 32. Similarly, the discharge valve 26 is biased toward a discharge valve seat 34, i.e. toward a closed position, by a discharge valve spring 36 positioned between the discharge valve 26 and a spring stop 38.

When the plunger 14 moves outwardly (to the left in FIG. 2) through a packing bore 40, a drop in pressure is created within the fluid chamber 22. This drop in pressure causes the suction valve 24 to move against the bias of spring 30 to an open position and causes fluid to flow through an intake pipe 25, through the suction valve 24 and into the fluid chamber 22. This phase of the plunger 14 movement can be referred to as a "suction stroke."

When the plunger 14 moves in a reverse direction (to the right in FIG. 2) through the packing bore 40, the suction valve 24 is closed by the spring 30, and pressure is increased in the fluid chamber 22. The increase in pressure causes the discharge valve 26 to open and forces fluid from the fluid chamber 22 outwardly through the discharge valve 26 and out a discharge pipe 35. The discharge valve 26 remains open while the plunger 14 continues to apply pressure (typically approximately 2 Ksi to approximately 12 Ksi) to the fluid in the fluid chamber 22. This high-pressure phase of the plunger 14 movement, in which fluid is discharged through the discharge valve 26, is known as a "discharge stroke."

Given a pumping frequency of 2 Hz (i.e., 2 pressure cycles per second), the fluid end 18 can experience very large number of stress cycles within a relatively short operational lifespan. These stress cycles induce fatigue failure of the fluid end 18. Fatigue involves a failure process where small cracks initiate at the free surface of a component under cyclic stress. The cracks grow at a rate defined by the cyclic stress and the material properties until they are large enough to warrant failure of the component. Since fatigue cracks generally initiate at the surface, a strategy to counter such failure mechanism is to pre-stress the surface in compression.

This can be done through an autofrettage process, which involves a mechanical pre-treatment of the fluid end 18 in order to induce residual compressive stresses at the internal free surfaces thereof (i.e. the surfaces that are exposed to the fracturing fluid in the fluid end cylinder 12). During autofrettage, the fluid end cylinder 12 is exposed to a high hydrostatic pressure. The pressure during autofrettage causes plastic yielding of the inner regions of the fluid end cylinder 12 walls. Since the stress level decays across the wall thickness, the deformation of the outer regions of the walls is still elastic. When the hydrostatic pressure is removed, the outer regions of the walls tend to revert to their original configuration.

However, the plastically deformed inner regions of the same walls constrain this deformation. As a result, the inner regions of the walls of the fluid end cylinder 12 inherit a residual compressive stress. This compressive stress enhances the fatigue resistance of the fluid end. The effectiveness of the autofrettage process depends on the extent of the residual stress on the inner walls and their magnitude.

One autofrettage process involves a single hydrostatic pressure step applied to each of the cylinders of a multi-cylinder pump, i.e. all three cylinders in the case of a triplex pump are deformed concurrently. The pressure depends on the pump size, for example in a multi-cylinder reciprocating pump having 5.5 inch diameter plungers, an autofrettage pressure of approximately 55 Ksi may be used.

However, computer models have shown this one step autofrettage process to be sub-optimal, leading to relatively low compressive residual stress in the central cylinder of the fluid end. This is due to the fact that the deformation of the central cylinder is constrained by the co-deforming side cylinders of the multi-cylinder pump leading to relatively low plastic strain in the central cylinder during autofrettage, and low residual compressive stress afterwards. As a result, the tensile stresses in the central cylinder can be relatively high, leading to relatively short operational lifespans for the fluid end 18.

In one embodiment, the above described autofrettage process on the fluid end 18 of a multi-cylinder pump 10 involves a two step process where in one step the central cylinder 12B is autofrettaged separately from the remaining cylinders 12A, 12C, and in another step either the remaining cylinders 12A, 12C or all of the cylinders 12A-12C are autofrettaged concurrently. Computer models have shown that such a two step process leads to an improved residual stress distribution in the fluid end 18, which leads to an increased lifespan for the fluid end 18.

Figure 3:
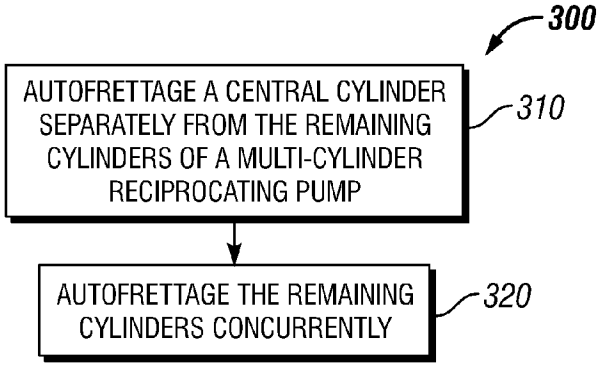
FIG. 3 is a diagram of one embodiment of an autofrettage process according to the present invention.

FIG. 3 illustrates a multi-step autofrettage process 300 for pre-treating the fluid end 18 of a multi-cylinder reciprocating pump 10 having at least three cylinders (cylinders 12A-12C in the case of the triplex pump 10 of FIG. 1.) The process of FIG. 3 used in conjunction with the pump 10 of FIG. 1 is as follows. In one embodiment the autofrettage process 300 includes a first step 310 that involves autofrettaging the central cylinder 12B separately from the remaining cylinders, in this case side cylinders 12A,12C. This step 310 involves applying a hydrostatic pressure on the central cylinder 12B only, and then releasing the hydrostatic pressure. In one embodiment, this hydrostatic pressure may be in the range of approximately 55 Ksi to approximately 65 Ksi.

A second step 320 involves autofrettaging the remaining cylinders, in this case side cylinders 12A,12C, concurrently, without autofrettaging the central cylinder 12B. This step 320 involves applying a hydrostatic pressure on the side cylinders 12A,12C only, and then releasing the hydrostatic pressure. In one embodiment, this hydrostatic pressure may be in the range of approximately 55 Ksi to approximately 65 Ksi.

In one embodiment the order of the above steps, steps 310 and 320, may be reversed, i.e. step 320 where the side cylinders 12A,12C are autofrettaged can be performed first; and step 310 where the central cylinder 12B is autofrettaged can be performed second. In either ordering of the steps, the autofrettage pressure on the central cylinder 12B may be higher than the autofrettage pressure on the side cylinders 12A,12C. Although exemplary autofrettage pressures are given above, other appropriate pressures may be used, even those outside the above range. In one embodiment the an optimal autofrettage pressure is determined from suitable computer models, which take into account the mechanical properties of the fluid end material, the autofrettaged process pressure, and the areas where the autofrettaged pressure is applied in the fluid end, among other factors.

Figure 4:
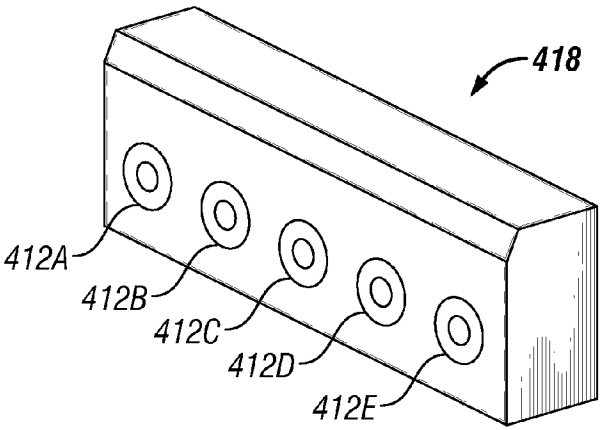
FIG. 4 is a schematic view of another multi-cylinder reciprocating pump for use in an autofrettage process according to the present invention.
Figure 5:
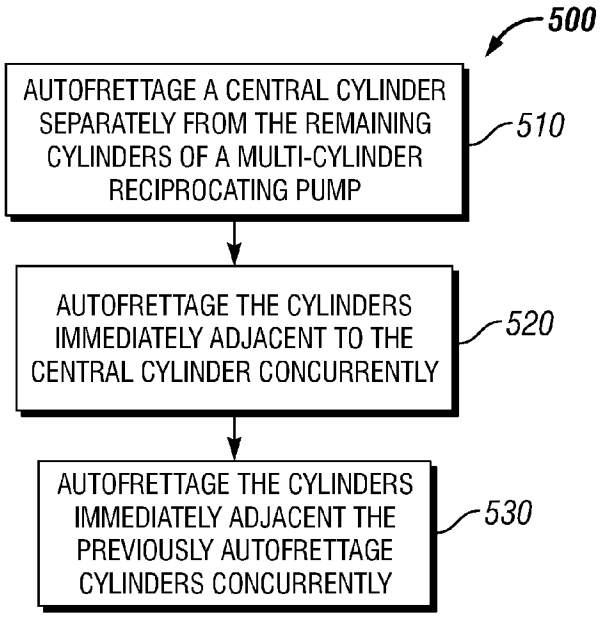
FIG. 5 is a diagram of another embodiment of an autofrettage process according to the present invention.

A multi-step autofrettage process may be applied to a triplex pump or to pumps with more than three cylinders, with a corresponding increase in the number of autofrettage steps. For example, FIG. 4 shows a schematic representation of the fluid end 418 of a quintuplex pump having five cylinders 412A-412E. The multi-step autofrettage process 500 of FIG. 5 shows one embodiment of steps involved in the autofrettage of such a pump.

As shown, in one embodiment a first step 510 involves autofrettaging the central cylinder 412C separately from the remaining cylinders. In this case the remaining cylinders include a first set of side cylinders 412B,412D, which are immediately adjacent to the central cylinder 412C and a second set of cylinders 412A,412E, which are one cylinder removed from the central cylinder 412C. This step 510 involves applying a hydrostatic pressure on the central cylinder 412C only, and then releasing the hydrostatic pressure. In one embodiment, this hydrostatic pressure may be in the range of approximately 55 Ksi to approximately 65 Ksi.

A second step 520 involves autofrettaging the first set of side cylinders 412B,412D concurrently and without autofrettaging the central cylinder 412C and the second set of side cylinders 412A,412E. This step 520 involves applying a hydrostatic pressure only on the first set of side cylinders 412B,412D concurrently, and then releasing the hydrostatic pressure. In one embodiment, this hydrostatic pressure may be in the range of approximately 55 Ksi to approximately 65 Ksi.

A third step 530 involves autofrettaging the second set of side cylinders 412A,412E concurrently and without autofrettaging the central cylinder 412C and the first set of side cylinders 412B,412D. This step 530 involves applying a hydrostatic pressure on the second set of side cylinders 412A, 412E concurrently, and then releasing the hydrostatic pressure. In one embodiment, this hydrostatic pressure may be in the range of approximately 55 Ksi to approximately 65 Ksi.

An addition autofrettage step can be performed for each progressive further set of side cylinders from the central cylinder 412C. In one embodiment the order of the above steps 510, 520 and 530 may be reversed and/or preformed in any order. Although exemplary autofrettage pressures are given above, other appropriate pressures may be used, even those outside the above range. In one embodiment, an optimal autofrettage pressure is determined from suitable computer models, as described above.

Figure 6:
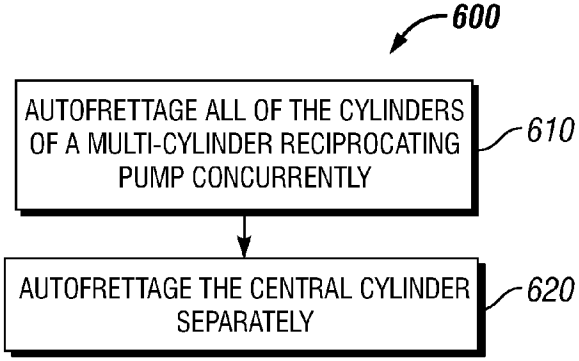
FIG. 6 is a diagram of yet another embodiment of an autofrettage process according to the present invention.

FIG. 6 illustrates a multi-step autofrettage process 600 for pre-treating the fluid end 18 of a multi-cylinder reciprocating pump having at least three fluid end cylinders. As shown, in one embodiment a first step 610 involves autofrettaging all of the cylinders in the fluid end concurrently (for example, all of the cylinders 12A-12C in the triplex pump of FIG. 1, or all of the cylinders 412A-412E in the quintuplex pump of FIG. 4.) This step 610 involves applying a hydrostatic pressure on all of the cylinders concurrently, and then releasing the hydrostatic pressure. In one embodiment, this hydrostatic pressure may be in the range of approximately 55 Ksi to approximately 65 Ksi.

A second step 620 involves autofrettaging only the central cylinder (for example, the central cylinder 12B in the triplex pump of FIG. 1, or the central cylinder 412C in the quintuplex pump of FIG. 4.) This step 620 involves applying a hydrostatic pressure on the central cylinder only, and then releasing the hydrostatic pressure. In one embodiment, this hydrostatic pressure may be in the range of approximately 55 Ksi to approximately 65 Ksi. Although exemplary autofrettage pressures are given above, other appropriate pressures may be used, even those outside the above range. In one embodiment, an optimal autofrettage pressure can be determined from suitable computer models, as described above.

Each of the above described multi step autofrettage processes 300, 500 and 600 result in an improved residual stress distribution in the pre-treated pump as compared to the single step procedure, with larger areas in the central cylinder under residual compressive stress. This minimizes the tensile stress that the fluid end experiences during pumping and leads to an extension of the fluid end operational lifespan. Note that although the above discussion focuses primarily on use of a multi-step autofrettage process for pre-treating a multi-cylinder pump that is a well fracturing application, such a pre-treated pump may be used in any other appropriate application. For example, exemplary applications in the oil well industry include coiled tubing applications, and cementing applications, among other appropriate applications.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A two-step autofrettage process for enhancing the fatigue resistance of a multi-cylinder reciprocating pump fluid end used to pump well stimulation fluids downhole, the process comprising:

arranging at least three fluid end cylinders in a linear fashion;

determining an optimal autofrettage pressure for a central cylinder of the at least three fluid end cylinders;

determining an optimal autofrettage pressure for the remaining at least two side fluid end cylinders;

autofrettaging the central cylinder separately from the remaining cylinders at the optimal central cylinder autofrettage pressure;

autofrettaging the remaining at least two side fluid end cylinders without autofrettaging said central cylinder at the optimal side fluid end cylinder autofrettage pressure;

wherein said autofrettaging the remaining at least two side fluid end cylinders is performed concurrently, yet independently of said autofrettaging of the central cylinder.

2. The process of claim 1, wherein said autofrettaging the remaining at least two side cylinders comprises concurrently autofrettaging the remaining at least two side cylinders.

3. The process of claim 1, wherein said step of autofrettaging the central cylinder is performed before said step of autofrettaging the remaining at least two side cylinders.

4. The process of claim 1, wherein said step of autofrettaging the remaining at least two side cylinders is performed before said step of autofrettaging the central cylinder.

5. The process of claim 1, wherein the multi-cylinder reciprocating pump is a triplex pump, such that the at least three fluid end cylinders comprises three cylinders.

6. The process of claim 1, wherein the multi-cylinder reciprocating pump is a quintuplex pump, such that the at least three fluid end cylinders comprises five cylinders.

7. The process of claim 1, wherein the multi-cylinder reciprocating pump is a heptaplex pump, such that the at least three fluid end cylinders comprises seven cylinders.

8. The process of claim 1, further comprising autofrettaging all of the at least three fluid end cylinders concurrently before autofrettaging the central cylinder of the at least three fluid end cylinders.

9. The process of claim 8, wherein the optimal central cylinder autofrettage pressure is greater than the optimal side fluid end cylinder autofrettage pressure applied to the remaining at least two side fluid end cylinders during said autofrettaging of all of the remaining at least two fluid end cylinders.

10. The process of claim 1, wherein at least two of the at least two side fluid end cylinders are disposed adjacent to one another.

11. The process of claim 1, wherein the at least three fluid end cylinders each comprises a fluid chamber intersecting a bore for slidably mounting a plunger, and wherein a corner is formed in each of the at least three fluid end cylinders where said fluid chamber intersects said bore for slidably mounting a plunger.

12. The process of claim 1, wherein determining an optimal autofrettage pressure for the central cylinder comprises determining the optimal autofrettage pressure from a computer model.

13. The process of claim 12, wherein determining the optimal autofrettage pressure from the computer model comprises utilizing at least one of mechanical properties of the fluid end material, the optimal autofrettage pressure, and the area of the fluid end to which the optimal autofrettaged pressure is applied.

14. The process of claim 1, wherein determining an optimal autofrettage pressure for the remaining at least two side fluid end cylinders comprises determining the optimal autofrettage pressure from a computer model.

15. The process of claim 14, wherein determining the optimal autofrettage pressure from the computer model comprises utilizing at least one of mechanical properties of the fluid end material, the optimal autofrettage pressure, and the area of the fluid end to which the optimal autofrettaged pressure is applied.

* * * * *